United States Patent [19]

Anderson

[11] 4,293,044

[45] Oct. 6, 1981

[54] MANUALLY-ACTUATED ROTARY-IMPACT TOOL

[75] Inventor: J. Edward C. Anderson, Moreland Hills, Ohio

[73] Assignee: Marquette Metal Products Co., Fountain Inn, S.C.

[21] Appl. No.: 100,365

[22] Filed: Dec. 5, 1979

[51] Int. Cl.[3] ..... B25D 15/02

[52] U.S. Cl. ..... 173/93.5

[58] Field of Search ..... 173/93.5, 48, 93; 81/463, 464, 56

[56] References Cited

U.S. PATENT DOCUMENTS 2,954,714 10/1960 Swenson ..... 173/93.5

3,094,021 6/1963 Young ..... 81/463

FOREIGN PATENT DOCUMENTS 218951 1/1942 France ..... 173/93

*Primary Examiner*—Werner H. Schroeder

*Assistant Examiner*—Andrew M. Falik

*Attorney, Agent, or Firm*—Arthur L. Frederick

[57] ABSTRACT

The manually-actuated, rotary-impact tool for rotatively driving a fastener has a spring in a handle for storage of energy, a rotatable tool head and an inertia member surrounding the tool head and connected to the handle via driving connections. A cam associated with the handle is provided to coact with the driving connections to disengage the driving connections when the tool head rotation is resisted by a predetermined force and the handle is rotated relative to the tool head and to allow re-engagement of the driving connections in another operative condition. A lever arm is pivotally connected to the handle so as to coact with the handle and inertia member to actuate the spring for storage of energy upon resistance of the tool head to rotation and to rotate the inertia member under the force of the stored energy of the spring and effect conversion of the kinetic energy of the inertia member to impact force on the tool head upon re-engagement of the driving connections. The pivotal connection of the lever arm is offset from the longitudinal axis of the handle.

5 Claims, 4 Drawing Figures

MANUALLY-ACTUATED ROTARY-IMPACT TOOL

This invention relates to manually-actuated, rotary-impact tools of the type disclosed in the U.S. patents to Swenson, U.S. Pat. No. 2,954,714, dated Oct. 4, 1960, U.S. Pat. No. 3,108,506, dated Oct. 29, 1963, and applicant's copending patent application, Ser. No. 934,005, U.S. Pat. No. 4,184,552 filed Aug. 16, 1978, for rotatively driving a fastener.

BACKGROUND OF THE INVENTION

In impact tools disclosed in the aforesaid patents, the energy stored in a spring is released to rotate an inertia or mass member which impacts against a tool head to rotate the latter when driving connections between the inertia member and tool head are brought into rotative alignment. In these devices, the inertia member is journaled on a cam which, in turn, is journaled on the tool head so that some of the spring thrust force is not only wasted, but imposes wear producing loads on the journal surfaces between the inertia member, cam and tool head. Also, as a result of the dissipation or wasting of some spring thrust force, such impact tools cannot tighten a fastener to the same degree as they might be capable of doing if there was not this loss of some of the spring thrust force. Therefore, these impact tools, to deliver impact forces of a specified magnitude, have to be made larger to compensate for the losses than would be required if those losses were substantially reduced. Also in the heretofore impact tools of the type shown in the cited patents, separate motion stops for limiting spring movement and rotation of the inertia member are required.

Accordingly, it is an object of the present invention to provide a manually-actuated, impact tool capable of providing greater impact force than impact tools of like type and of comparable size.

It is another object of this invention to provide a manually-actuated, impact tool of relatively simple construction, of high efficiency, and improved reliability.

SUMMARY OF THE INVENTION

Accordingly, the present invention contemplates an improved manually-actuated, impact tool of the type comprising a rotatable tool head for engaging a fastening member and a rotational inertia member surrounding the tool head and capable of rotation relative to the tool head. A driving connection is provided between the inertia member and the tool head. An operating handle is disposed adjacent to and capable of movement relative to the inertia member. The handle is constructed and arranged so that its longitudinal axis extends through the rotational axis of the inertia member. A means is provided for coacting with said driving connections for effecting disengagement of said driving connections, when movement of the tool head is resisted by a predetermined force and the handle moves relative to the inertia member, and for effecting reengagement of said driving connections in another operative condition. A spring means is disposed in the handle. A force transmission means coacts with said handle and inertia member to actuate said spring for the storage of energy upon the relative movement of the handle and inertia member and to transmit such stored energy to the inertia member to rotate the inertia member and thereby effect the application of impact force on the tool head upon re-engagement of the driving connections. The improvement, according to this invention, resides in a force transmission means which includes a lever arm pivotally connected to said handle so as to engage the inertia member and, upon movement of the handle relative to the inertia member, effect loading of the spring means and to be rotationally accelerated about the pivotal connection by the spring means to thereby rotationally drive the inertia member. The lever arm also coacts with the inertia member and the handle to provide motion stops for limiting spring and inertia member movement.

In a more narrow scope, the inventive improvement comprises a slide which is disposed in the handle for linear movement relative to the handle and between the spring means and the lever arm, the spring means biasing the slide toward and into engagement with the lever arm, so that the latter is pivoted upon linear movement of the slide under the force of the spring means.

It has been found that the manually-actuated, impact tool of this invention, by more direct application of stored spring energy on the inertia member and absorption of the non-rotational energy by the pivotal lever arm, achieves greater impact forces than is possible with comparable size manually-actuated impact tools of the type disclosed in the aforesaid United States patents. In addition, the use of a pivotal lever arm rather than a thrust link carried by a crosshead assembly, which link is pivotally connected to the crosshead assembly and inertia member as shown in the Swenson U.S. Pat. No. 2,954,714, results in the reduction of bearing loads so that wear is minimized and operative life is increased. Since the lever arm coacts with the handle and inertia member to limit movement of the spring means and inertia member, no separate limit stops are required and the impact tool is, therefore, of simpler construction than the heretofore known impact tools.

BRIEF DESCRIPTION OF THE DRAWINGS

The invention will be more fully understood from the following detailed description thereof when considered in connection with the accompanying drawings and in which.

DESCRIPTION OF THE PREFERRED EMBODIMENTS

Figure 1:
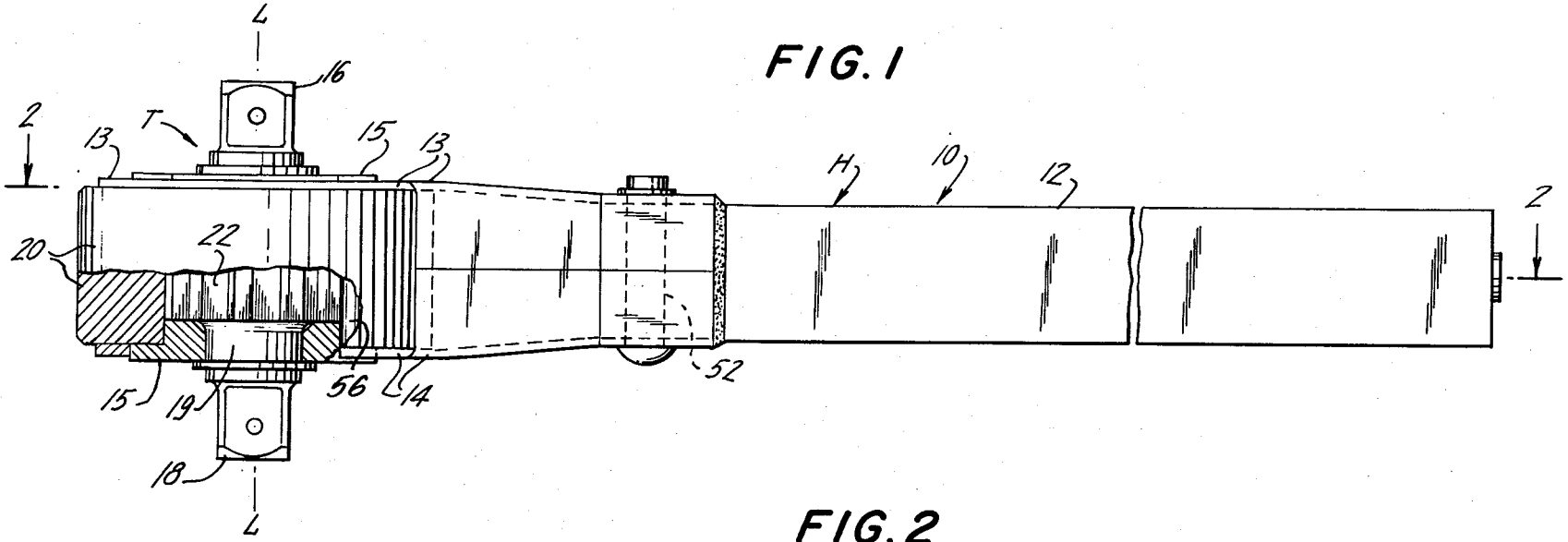
FIG. 1 is a side elevational view of a manually-actuated impact tool, according to this invention, in which parts thereof are broken away for illustration purposes.

Now referring to the drawings, the reference number 10 generally designates the manually-actuated, impact tool according to the present invention. The impact tool 10 comprises a handle H formed in any suitable manner, to which a tool head T is supported on cam-bearings 15 (only one shown in FIG. 2). As illustrated in the drawing, handle H may be constructed of a tubular portion 12 which is generally rectangular in cross section and which is connected at one end to two side plate portions 13 and 14. The side plate portions 13 and 14 may be connected by welding or in any other suitable manner secured to tubular portion 12 so as to project in spaced parallel relationship to each other. The cambearing bushings 15 are rotationally fixed to each of the side plate portions 13 and 14 by radial projections 17 which fit within complementary notches in the side plate portions.

The tool head T may, as shown, be of the construction disclosed in the U.S. patents to Swenson, U.S. Pat. No. 2,954,714 and U.S. Pat. No. 3,108,506. As shown, tool head T may comprise socket holders or drive stub portions 16 and 18 which are integral extensions of a circular shaft portion 19 which turn freely in the cambearings 15. Disposed around and freely rotatable on the external peripheral surfaces of cam-bearings is an annular rotor or inertia member 20.

The inertia member 20 is of doughnut shape and closely surrounds a ratchet-toothed portion 22 which also forms part of tool head T and is connected to circular shaft portions 19. A plurality of circumferentially equi-spaced pawls 24 are disposed in cavities 26 in the inner surface of the inertia member 20. Each of the pawls 24 is carried by and pivotally movable relative to inertia member 20. A spring 28 is disposed in each cavity to bias the associated pawl in a direction to engage a ratchet tooth of ratchet-toothed portion 22. The camming surfaces 23 of cam-bearings 15 which move with handle H are operable against pawls 24 and function, upon a predetermined angular movement of handle H about the axis L—L of tool head T in a predetermined direction, to effect intermittent impacts between the pawls 24 and the ratchet teeth pursuant to a predetermined angular indexing movement of handle H or upon continuous movement of the handle H with reference to a fastener (not shown) to which the tool head T is coupled.

To provide for accelerating the inertia member and thus provide the desired impact in accordance with the formula $f=mv^2/2$ wherein f is force, m is mass and v is velocity, impact tool 10 has a spring assembly 30 disposed in handle H and an improved force transmission means 32, according to this invention.

The spring assembly 30 may comprise a single spring or, alternatively and preferably, two springs 34 and 36 disposed in handle H as shown in the drawings. The use of two springs is preferred because it provides a greater energy storage capacity relative to overall length of the impact tool and provides a handle of a cross-sectional shape for a comfortable grip while at the same time providing a greater energy storage capacity than possible with a single spring in the same size and shape handle. The springs 34 and 36 are disposed between an adjustable abutment 38 and a crosshead or slide 40 which forms part of force transmission means 32. For the adjustment of the force exerted by springs 34 and 36, an adjustment nut 42 is fixed against movement in the end of handle H adjacent abutment 38 and an adjustment screw 44 is turned into the threaded hole 46 of nut 42 so that its shank extends beyond the hole and into contact with adjustable abutment 38. By rotation of screw 44, adjustable abutment 38 is axially shifted in handle H to thus change the amount of pre-set compression of springs 34 and 36. To guide the springs in their compression and extension and prevent their buckling, a guide rod (not shown) may be disposed within the coils of each spring. Each guide rod (not shown) may be anchored at one end in abutment 38 and at the opposite end, slidably receivable in a bore (not shown) in crosshead 40 so as to be capable of axial movement relative to crosshead 40.

Figure 2:
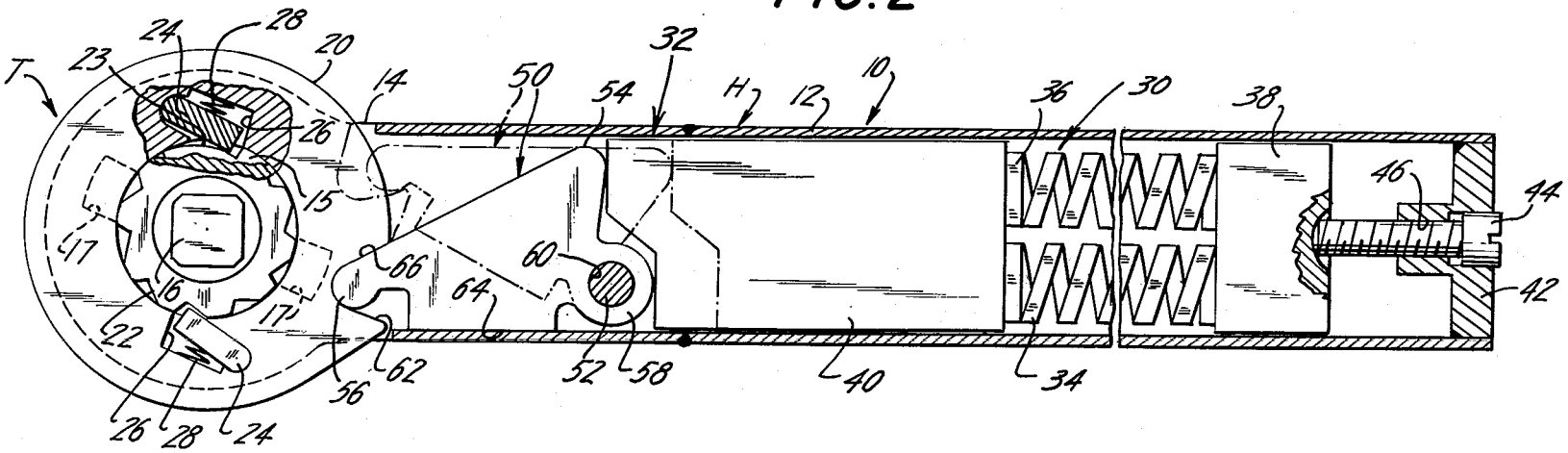
FIG. 2 is a cross-sectional view taken substantially along line 2—2 of FIG. 1.
Figure 3:
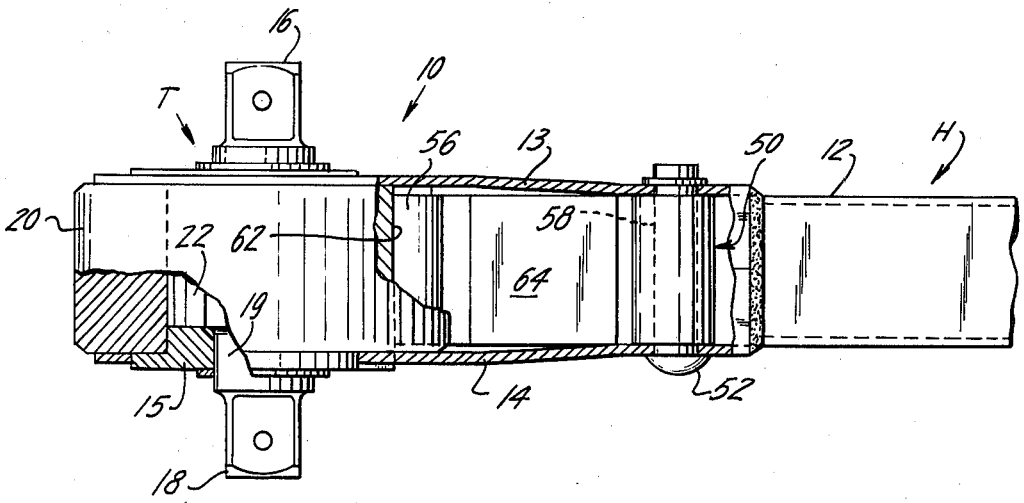
FIG. 3 is a fragmentary view in elevation with parts broken away to show the lever arm according to this invention.
Figure 4:
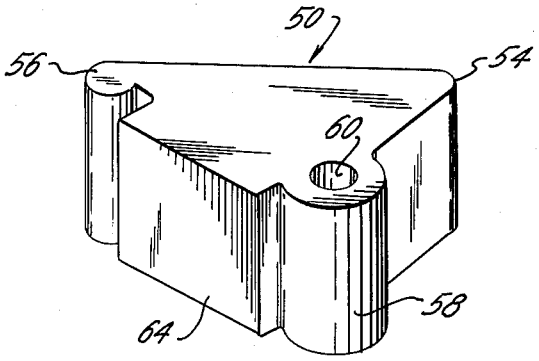
FIG. 4 is a perspective view of the lever arm.

The force transmission means 32, in addition to crosshead 40, comprises a lever arm 50 which is pivotally secured within handle H by a pivot pin 52. As best shown in FIG. 4, lever arm 50 comprises a body portion having a generally triangular shape and with two rounded apex portions 54 and 56. The body portion has cylindrical projection 58 which is provided with a bore 60 for receiving therethrough pivot pin 52. As shown in FIG. 2, lever arm 50 is dimensioned so that apex portion 54 engages the end surface of crosshead 40 opposite the end surface engaged by springs 34 and 36 and apex portion 56 is received in and engages a notch 62 in the peripheral surface of inertia member 20. In addition, lever arm 32 has a projecting flat surface 64 which abuts the inner surface of handle H and a surface 66 for abutting the notch surface in inertia member 20 to limit the rotative movement of inertia member 20 and the extension of springs 34 and 36. As shown in FIG. 2, pivot pin 58 and, hence the pivotal axis of lever arm 32, is located in a position offset from the longitudinal axis of handle H which axis is in a plane passing through axis L—L of tool head T.

In the use of manually actuated impact tool 10, the fastener (not shown) to which impact tool 10 is coupled by suitable engaging means, such as a socket (not shown), is turned by turning handle H either continuously in one direction (clockwise as viewed in FIG. 2) or intermittently by oscillating motion causing ratcheting action of pawls 24. When the fastener offers resistance to turning of a magnitude sufficient to overcome the tensional force of springs 34 and 36, the handle H rotatively moves relative to inertia member 20 and ratchet-toothed portion 22. This relative movement forces crosshead 40, via pivotal movement of lever arm 50, to the position shown in dot-dash lines, to thereby compress springs 34 and 36 and thus load the springs. Simultaneously, this relative movement rotates cambearings 15 and their camming surfaces 23 relative to pawls 24. The movement of the camming surfaces 23 relative to the pawls causes pivotal movement of the pawls out of the path of the ratchet teeth against the force of springs 28. When the camming surfaces 23 move sufficiently to release pawls 24, the stored spring force linearly drives crosshead 40 toward inertia member 20 (to the left as viewed in FIG. 2). Since apex portion 54 is in engagement with crosshead 40, this linear movement of crosshead 40 rotates lever arm 32 about pivot pin 52 from the dot-dash line position thereof to the full line position of the lever arm. With apex portion 56 engaging notch 62 in the periphery of inertia member 20, inertia member 20 is rotatively accelerated from its dot-dash position to its full line position. This rotation of inertia member 20 carries pawls 24 into impact against the next adjacent ratchet teeth, thus rotatively indexing tool head T and the fastener. It is seen, therefore, that the ratchet teeth serve as anvils while pawls 24 function as hammers. As previously stated, rotative movement of inertia member 20, linear movement of crosshead 40 and extension of springs 34 and 36, is limited by the coaction of surface 64 of lever arm 50 abutting handle H and the surface 66 of lever arm 50 abutting a surface of notch 62 of inertia member 20.

It is believed now readily apparent that a manually-actuated, impact tool has been disclosed which more efficiently converts the stored spring energy into kinetic energy of the tool head. It is a manually-actuated, impact tool wherein loadings on cam-bearings are minimized thus reducing their wear and thereby providing an impact tool of longer operative life than heretofore known impact tools of the same type.

Although but one embodiment of the invention has been illustrated and described in detail, it is to be expressly understood that the invention is not limited thereto. Various changes can be made in the arrangement of parts without departure from the scope and spirit of the invention as the same will now be understood by those skilled in the art. For example, spring assembly 30 may be any suitable energy storage means, e.g. an air bag or solid block of resilient material, instead of a spring or springs.

What is claimed is:

1. In a manually operable impact tool comprising a rotatable tool head for engaging a fastening member, a rotational inertia member surrounding said tool head and capable of rotation relative to said tool head, a driving connection between said inertia member and tool head, an operating handle having its longitudinal axis extending through the rotational axis of said inertia member disposed adjacent to and capable of movement relative to said inertia member, means coacting with said driving connections for effecting disengagement of said driving connections when movement of said tool head is resisted by a predetermined force and the handle moves relative to the inertia member and for effecting reengagement of said driving connections in another operative condition, spring means disposed in said handle, force transmission means coacting with said handle and inertia member to actuate said spring for the storage of energy upon said relative movement of the handle and inertia member and to transmit such stored energy to the inertia member to rotate said inertia member and thereby effect the application of an impact force on said tool head upon re-engagement of said driving connections, said force transmission means includes a lever arm pivotally connected to said handle so as to engage said inertia member and connected to be rotationally accelerated about the pivotal connection by said spring means to thereby rotatively drive said inertia member, and said lever arm pivotal connection being offset from the longitudinal axis of said handle.

2. The apparatus of claim 1 wherein said lever arm coacts with the handle and the inertia member to automatically limit rotative movement of said inertia member by engagement with both the handle and inertia member.

3. The apparatus of claim 1 wherein a slide is disposed in the handle for linear movement relative to the handle and with one end of the spring means engaging the slide to bias the latter toward said inertia member and wherein said lever arm is disposed between the slide and the inertia member.

4. The apparatus of claim 3 wherein said spring means comprises two helically wound coil springs.

5. The apparatus of claim 4 wherein said two springs are disposed to extend side-by-side in the handle.

* * * * *